United States Patent [19]

von Wedel

[11] Patent Number: 4,966,548

[45] Date of Patent: Oct. 30, 1990

[54] GRATE COOLER DEVICE FOR THE HEAT TREATMENT OF BULK MATERIAL

[76] Inventor: Karl von Wedel, Amselstrasse 5, 3057 Neustadt 1, Fed. Rep. of Germany

[21] Appl. No.: 454,970

[22] Filed: Dec. 22, 1989

[30] Foreign Application Priority Data

Dec. 30, 1988 [DE] Fed. Rep. of Germany ..... 3844493

[51] Int. Cl.[5] ..... F27D 15/02

[52] U.S. Cl. ..... 432/77; 432/137; 432/78; 110/283

[58] Field of Search ..... 432/77, 78; 110/283, 110/300

[56] References Cited

U.S. PATENT DOCUMENTS

| | | | |
|---|---|---|---|
| 3,358,385 | 12/1967 | Maberry | 432/77 |
| 4,106,893 | 8/1978 | Baumann et al. | 432/137 |
| 4,457,081 | 7/1984 | von Wedel | 432/77 |
| 4,600,380 | 7/1986 | von Wedel | 432/58 |

OTHER PUBLICATIONS

Zement-Kalk-Gips, vol. 37, 5/1984, "Are Cooling Grates Clinker Coolers or Heat Recuperators?", K. von Wedel et al, pp. 244–247.

*Primary Examiner*—Henry C. Yuen

*Attorney, Agent, or Firm*—Fay, Sharpe, Beall, Fagan, Minnich & McKee

[57] ABSTRACT

The heat treatment of solids by combustion, cooling, or the like with the aid of gas may take place on a grate conveying such solids while the gas is passed through openings in the surface of the grate. In order to provide lateral clearances of such grates with the same order of narrowness as the majority of the grate's openings, the mobile framework of the grate is suspended by tension elements inclined at an angle of at least 3 degrees relative to the perpendicular. If the mobile frame deviates from a straight course, the inclined suspension creates a centering force guiding the mobile frame without mechanical contact and wear. As a result, the lateral clearances for thermal expansion and building tolerances are reduced from about 20 to 2 mm.

5 Claims, 4 Drawing Sheets

GRATE COOLER DEVICE FOR THE HEAT TREATMENT OF BULK MATERIAL

BACKGROUND OF THE INVENTION

1. Field of the Invention

The present invention generally relates to grate coolers for the heat treatment of particularly fine bulk material transported along such grate coolers, and in particular to the support or the suspension of a mobile framework of such grate coolers as well as to the interaction of its mechanical wear and the process efficiency of the grate cooler.

2. Prior Art

Conventional grate coolers comprise an upper housing and a lower housing, the latter being pressurised by a cooling medium for the bulk material; a plurality of transverse rows of grate plate (with respect to the direction of transport of the material), wherein the rows are at least partially mobile, and the grate plates partially overlap each other; a mobile framework consisting of transverse beams and longitudinal beams carrying the transverse mobile rows of grate plates; and either one of a support of the mobile framework comprising axles running on rollers or rotating axles with annular rails running on flat rails, or suspension means for the said mobile framework formed by long elongated tension strands, replacing the aforementioned axles or rollers, etc.

In order to effect the material transport the mobile framework is stroked back and forth. Normal operation is carried out at between 3 to 30 strokes per minute of 70 to 150 mm length as allowed by the overlapped length of consecutive rows of grate plates. The strokes are generated either mechanically by excenter drives or by hydraulic drives.

The majority of hitherto utilised grate coolers comprise a mobile frame or framework, which is supported either by axles running on rollers, or by rotating axles with annular rails running on flat rails. The lateral guidance of the mobile frame is provided by flanges of the rollers or rails. In many cases there exist additional thrust rollers. The frame may be stiffened further by diagonal tension rods. Due to the wear of rollers, roller bearings, and rails the mobile frame gradually works its way down thereby losing its resistance property. About once a year the supported mobile framework has to be reset and/or realigned.

In order to overcome such regular maintenance and repair requirements there has been developed a structure in which the framework is suspended by long tension strands arranged in parallel to the perpendicular, longitudinal plane of the grate cooler, and inside of compartments attached to the upper housing portion of the grate cooler. The lateral guidance is provided by friction plates attached to the transverse beams, which friction plates engage counter plates fixed to the lower housing portion. In addition, tension chains extend for the longest distance between the mobile frame and the undergrate housing. Despite its merit with respect to the wear of rollers and rails, this design has finally been abandoned because of lack of lateral stability of the mobile frame.

Extra rigidity of the mobile framework is required in the case of a hydraulic grate drive with opposite pairs of hydraulic cylinders. The work loads of the cylinders may become so uneven that the cylinder of one side performs practically all the work while the opposite one runs idle. The rigidity of the mobile frame has to compensate for such uneven work loads.

Consequently, the flanged rollers, thrust rollers, or friction plates, or whatever may serve as a mechanical lateral guide of the mobile frame, are subject to wear. The wear adds to the allowances made for the thermal expansion of the rows of grate plates and results in a fairly large lateral clearance and consequently, in a decrease in the overall resistance of the grate.

This grate resistance has been an essential problem in grate cooler development and design over the past years. It is a main aim to design grate coolers of optimal resistance against the passage of the cooling medium. According to recent improvements the quality of grate coolers depends largely on their resistance against the passage of the cooling medium as the resistance warrants the even distribution of the cooling medium into the bulk material (cf. K. von Wedel and R. Wagner) "Are cooling grates clinker coolers or heat recuperators? Theoretical and practical limits of cross-flow cooling. Translated from the journal "Zement-Kalk-Gips", 37th volume, 5/1984, page 244–247). Said resistance is achieved by fine and evenly distributed openings of the grate surface. With this in mind, a grate has been developed (U.S. Pat. No. 4 600 380) comprising grate elements in the form of a box to be placed upon individually aerated, hollow grate beams. Said hollow beams and grate elements, taken per se, show the desired resistance property. However, this does not influence the aforementioned losses in the lateral guide regions, as the narrow openings of said hollow beams constitute the resistance of the major part of the grate surface, only. As long as there are uncontrolled openings or openings subject to wear, the benefits of the resistance concept cannot be fully utilized. The uncontrolled openings are like weak links in a chain.

As a consequence of said loss of grate resistance the hazard of channelling of the cooling medium grows. Channelling is observed especially at the sides, which also causes wear of the refractory lining by sandblasting. The grate's life between repair campaigns is often limited by the wear starting from one of the two lateral clearances. Once the guiding flanges or friction plates no longer limit the course of the mobile frame, the friction between mobile grate plates and side boards takes over. As wear proceeds at one side, clearance at the opposite side becomes larger.

3. Objects of the Invention

It is the main object of the present invention to suggest a grate cooler whose lateral clearances can be designed narrow enough to meet the requirements for a high resistance grate cooler.

It is another major object of the invention to provide a practically wearless lateral guide of the mobile framework.

It is yet another essential object of the present invention, particularly with regard to said known grate coolers incorporating hollow beams and box-shaped grate plates arranged on the beams, to match the lateral clearances between the mobile beams and the fixed structure of the grate cooler as well as the clearances between fixed and mobile rows of grate plates to the resistance achieved by said hollow beams.

SUMMARY OF THE INVENTION

In a grate cooler comprising an upper and a lower housing; a plurality of rows of grate plates arranged transversely with respect to the direction of transport of the bulk material, said rows being at least partially mobile, and said grate plates partially overlapping each other; a mobile frame formed by longitudinal and transverse beams carrying said grate plates; and elongated tension strands for supending the mobile frame means, these objects are achieved, according to the invention, by tension strands, which form an angle of more than 3 degrees relative to the perpendicular, longitudinal plane of the grate cooler. Depending on said angle the dead weight of the grate, i.e. gravity, leads to a pair of horizontal forces within the transverse beams, which are in balance, when the mobile frame is in its central position. As the mobile frame deviates from its central position, said pair of forces becomes uneven and a resulting force counteracts any forces, which have led to the deviation from the central position. Depending on the size of the angle of suspension, slight deviations will create a central force strong enough to guide the mobile frame laterally without any friction and wear.

According to a preferred embodiment of the invention, the tension strands may be made of unilaterally flexible plate-springs, so that the strands will be flexible in the direction of transport, only, whereas they are firmly fixed with regard to the transverse beams against any motion perpendicular to the direction of flexibility. The forces resulting from the rigidity of the frame constituted by said plate-springs and the transverse beam add to the centering forces caused by any inclination of the tension strands and the operating weight of the mobile frame. With such strong lateral guidance of the mobile frame even a hydraulic drive with only one cylinder under load will be applicable and considered admissable.

According to another advantageous embodiment of the invention, there may be provided upwardly inclined, airtight hollow extensions arranged on the lower housing, which extensions will enclose the tension strands. Even though the lower housing may appear to be somewhat strange in shape, this is rather expedient, since, according to yet a further embodiment, these extensions of the lower housing may serve as ducts for the supply of the cooling medium to the lower housing. Thanks to this arrangement some of the normally used fans may be relocated to the burner platform usually extending above the grate cooler. The benefits of this solution with respect to the object of the invention lie in improving the temperature control of the tension strands, as the cooling medium will be of sufficiently constant temperature. Any variation of the length of the tension strands by thermal expansion will thus be excluded. In view of the total length of the tension strands, which is needed to enable wide circles for practically flat strokes, said thermal expansion would otherwise be intolerable.

BRIEF DESCRIPTION OF THE DRAWINGS

Other and further objects of the present invention will be apparent from the following description and claims and are illustrated in the accompanying drawings, which by way of illustration schematically show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the drawings

DETAILED DESCRIPTION OF THE PREFERRED EMBODIMENTS

Figure 1:
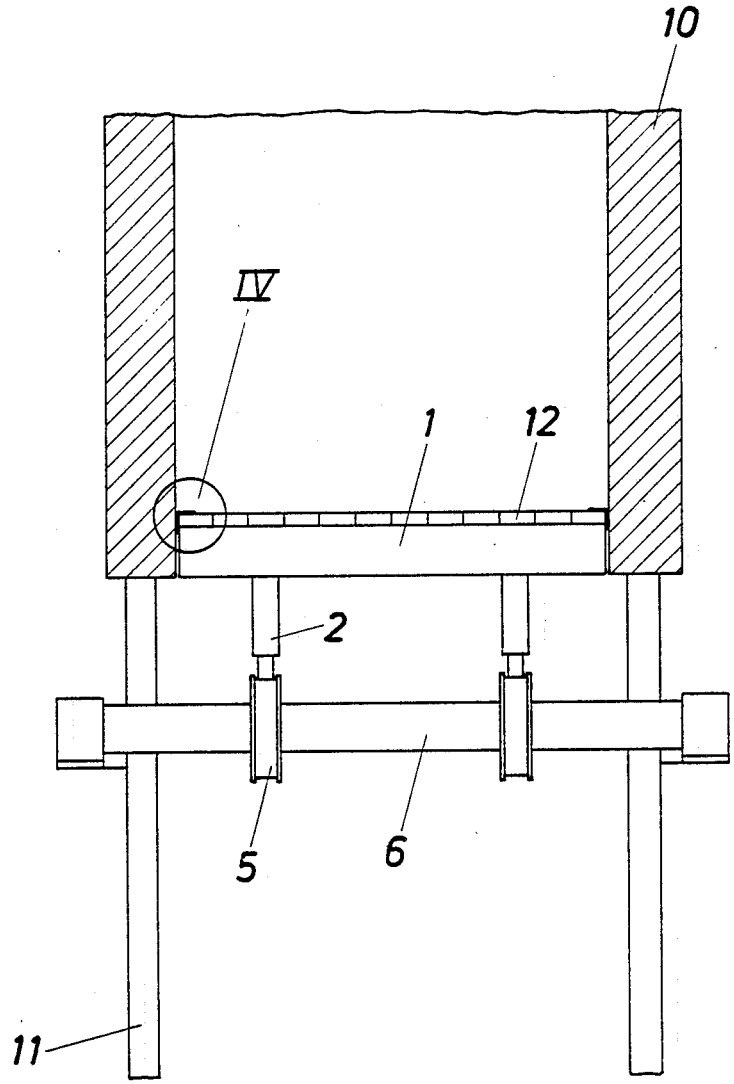
FIG. 1 shows a cross section through part of a prior art grate cooler.

The cross-sectional view of a prior art type grate cooler of FIG. 1 shows an upper grate housing extending between the surface of grate plates 12 and a refractory lining 10, and a lower grate housing extending between side walls provided with supports 11 up to the bottom of grate plates 12 and up to the bottom of mobile beams 1, respectively. For the sake of simplicity, the roof of the upper housing as well as the bottom or floor of the lower housing, which may be located beyond the area covered by the invention, have been omitted from the representation of the grate cooler in the drawings.

Figure 4:
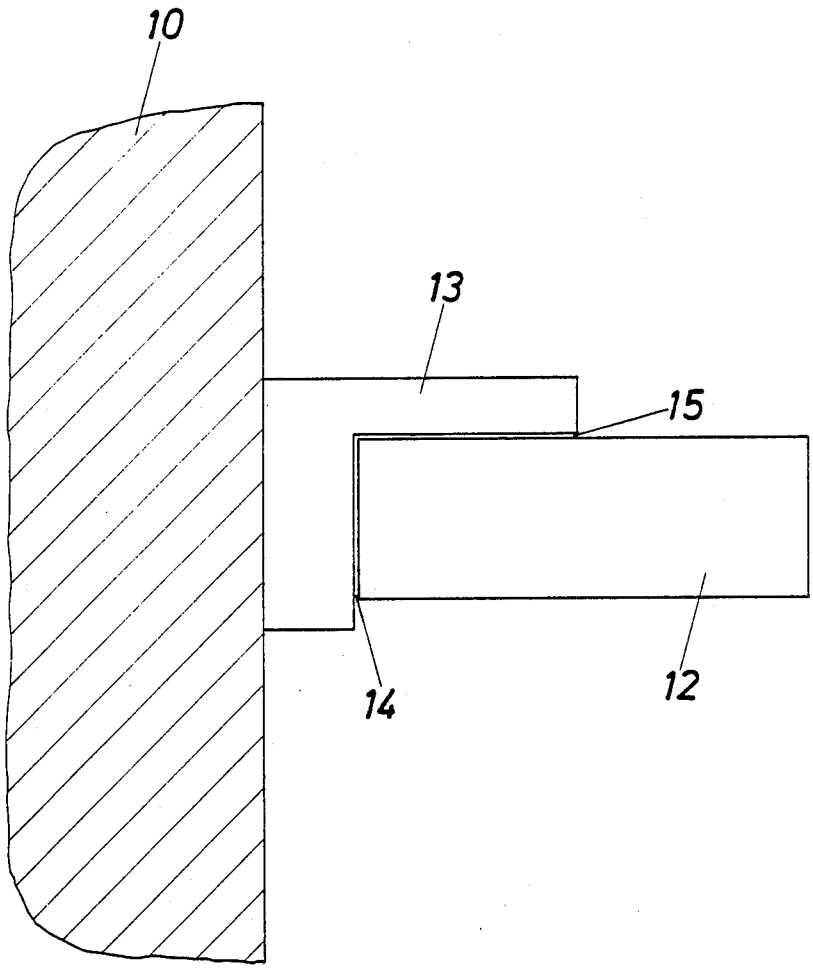
FIG. 4 shows a detail IV of FIG. 1 to 3 in an enlarged scale.

A mobile frame as shown in FIG. 1 comprises the above-mentioned mobile beams 1, which carry a plurality of said grate plates 12, longitudinal beams 2 and axles 6 carrying rollers or annular rails 5, which have flanges and form a lateral guide of the mobile frame. Detail IV reflected by FIG. 4 shows the refractory side lining 10, a fixed side board 13, and a mobile grate plate 12. Between the side board 13 and the plate 12 there is a vertical lateral gap or clearance 14 and a horizontal gap or clearance 15. The horizontal clearance mainly exists between fixed rows of not shown grate plates and the mobile row of grate plates 12. The clearances 14 and 15 are required to allow for tolerances of measurements, of erection and of deviations due to wear, and for thermal expansion. Typically, the lateral clearance 14 in the prior art constructions is sized in the order of 20 mm and the horizontal clearance 15 is sized in the order of 6 mm. Said sizes refer to the design status and may even have to be increased after a certain period of operation.

Figure 2:
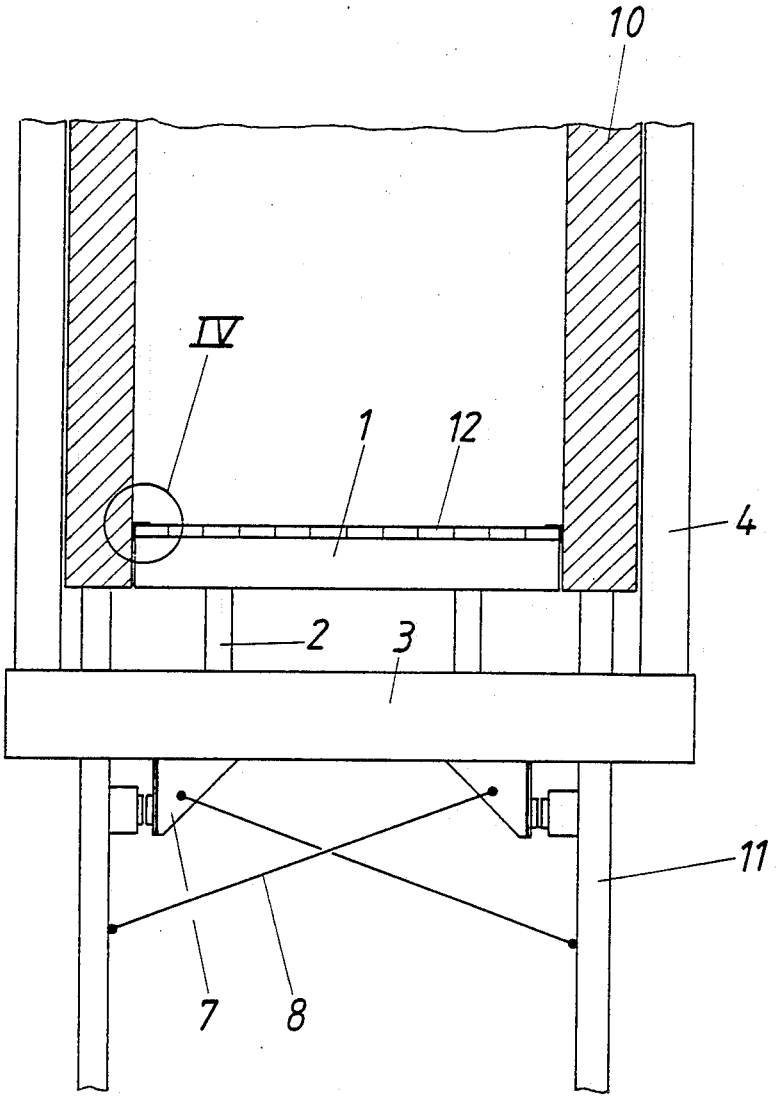
FIG. 2 shows a cross section through part of another prior art construction grate cooler.

FIG. 2 shows another prior art grate structure improved over the one shown in FIG. 1. In place of mobile axles 6 there are provided transverse beams 3 carrying the longitudinal beams 2. The transverse beams 3 are suspended by tension strands 4. The housing detail and the upper joints of tension strands 4 are not shown. The suspended mobile frame is laterally guided by friction plates 7. In addition there may be diagonal chains 8 stretched diagonally between supports 11 and the transverse beams 3. It is obvious that the suspended frame acts and wears severely on the friction plates 7. Also the chain links wear rapidly so that it was found that the desired guide was no longer existent after rather short operation.

Figure 3:
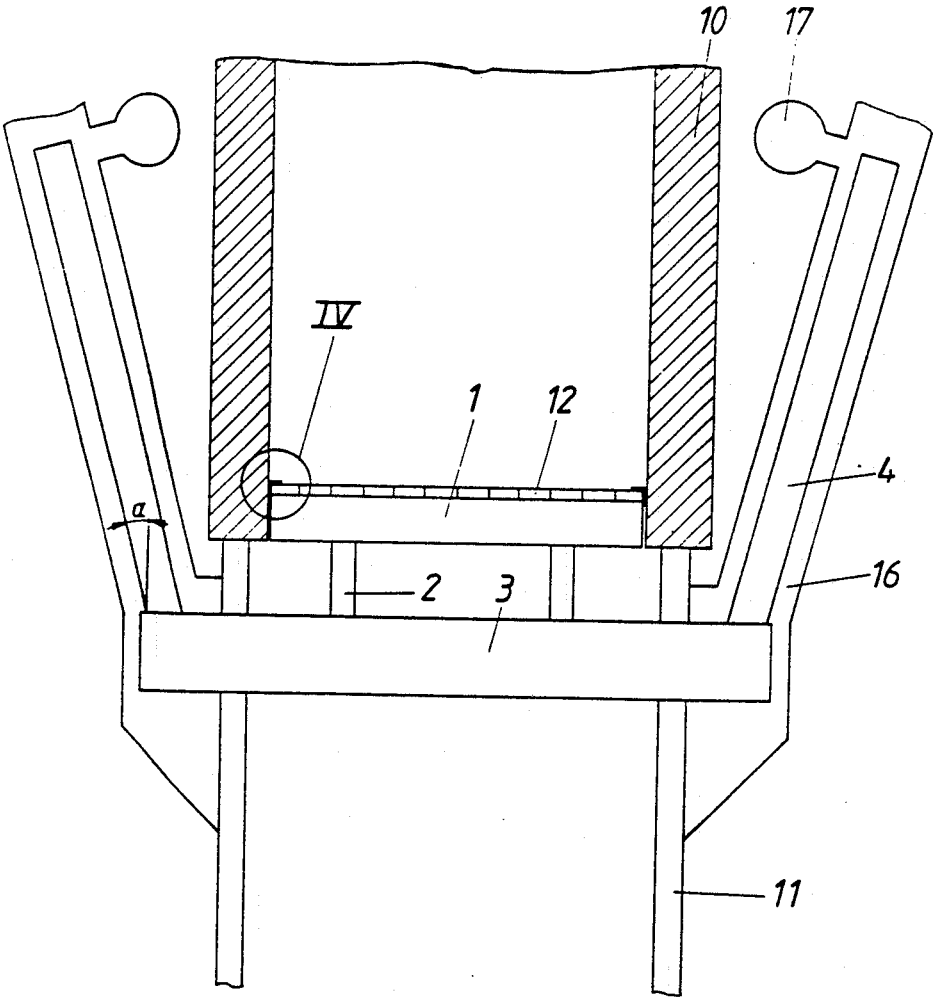
FIG. 3 shows a cross section through part of a grate cooler embodying the present invention.

In contrast to the prior art structure, in the embodiment designed according to the invention and shown in FIG. 3, the tension strands 4 form an angle $\alpha$ of 15 degrees with regard to the (imaginary) perpendicular, longitudinal plane of the grate cooler. Said angle may vary between 3 and 45 degrees in order to turn any portion of the mobile frame's weight into a desired centering force. Said forces created in the transverse beam 3 by any deviation from a straight course take over the function of the friction plates 7 and chains 8 of FIG. 2 or of the flanged rollers 5 of FIG. 1.

By shaping the tension stands 4 as plate-springs flexible in the direction of transport, and rigid in the transverse direction and firmly fixed to the transverse beams 3, the rigidity of the frame constituted by the tension strands 4 and transverse beams 3 adds to the centering forces built up by the angle $\propto$ arrangement of the tension strands. The clearances 14 and 15 of FIG. 4 can now be sized in the order of 2 mm each without the hazard of any blockage caused by an engagement of the mobile frame.

The clearances 14 and 15 will maintain their narrowness of 2 mm irrespective of wear. The flow resistance of the clearances 14 and 15 against the passage of the cooling medium thus corresponds to the resistance already provided by the grate construction as disclosed by U.S. Pat. No. 4 600 380.

FIG. 3 show airtight, inclined hollow extensions 16 of the lower housing, which extensions enclose the tension strands 4 and are connected to supply ducts 17 for the cooling medium to be supplied to the grate for cooling the material processed thereon. In operation of the cooling grate the tension strands 4 are kept at the temperature of the cooling medium, which in practice is constant and will exclude any variation of the length of the tension strands due to thermal expansion, which may be caused by varying temperatures of the refractory lining 10 or the lower housing. The FIG. 3 embodiment enables the most narrow clearances 14 or 15 irrespective of wear and thermal expansion.

What is claimed is:

1. A grate cooler device for the heat treatment of particularly fine, bulk material to be transported along said grate cooler device in a predetermined direction, comprising (a) upper and lower housing means; said lower housing means being charged with a pressurised cooling medium;

(b) a plurality of rows of grate plates arranged transversely with respect to said direction of transport of said bulk material, said rows being at least partially mobile, and said grate plates partially overlapping each other;

(c) mobile frame means formed by longitudinal and transverse beams carrying said grate plates; and (d) elongated tension strand means for suspending said mobile frame means, wherein (e) said tension strand means form an angle $\alpha$ of more than 3 degrees relative to an imaginary perpendicular plane of said grate cooler extending in said direction of transport.

2. A device as claimed in claim 1, wherein said tension strand means comprise of unilaterally flexible plate-springs, which are flexible in said direction of transport and firmly fixed against motion transverse to said direction of transport.

3. A device as claimed in claim 1, wherein upwardly inclined, airtight hollow extensions are arranged on said lower housing means to enclose said tension strand means.

4. A device as claimed in claim 3, wherein said hollow extension means are associated with and connected to duct means arranged within said device for supplying said cooling medium to said lower housing means.

5. A device as claimed in claim 2, wherein upwardly inclined, airtight hollow extensions are arranged on said lower housing means to enclose said tension stand means.

* * * * *

UNITED STATES PATENT AND TRADEMARK OFFICE

CERTIFICATE OF CORRECTION

PATENT NO. : 4,966,548

DATED : October 30, 1990

INVENTOR(S) : Karl von Wedel

It is certified that error appears in the above-identified patent and that said Letters Patent is hereby corrected as shown below:

Claim 5, line 3, change "stand" to --strand--.

Signed and Sealed this

Nineteenth Day of May, 1992

*Attest:*

DOUGLAS B. COMER

*Attesting Officer*

*Acting Commissioner of Patents and Trademarks*